US008074300B1

(12) United States Patent
Molina

(10) Patent No.: US 8,074,300 B1
(45) Date of Patent: Dec. 13, 2011

(54) ARTICLE OF CLOTHING

(76) Inventor: Juan Carlos Molina, Miramar, FL (US)

( * ) Notice: Subject to any disclaimer, the term of this patent is extended or adjusted under 35 U.S.C. 154(b) by 431 days.

(21) Appl. No.: 12/261,176

(22) Filed: Oct. 30, 2008

(51) Int. Cl.
*A42B 1/08* (2006.01)

(52) U.S. Cl. ..... 2/424; 2/84; 2/5; 2/85; 2/93; 2/202

(58) Field of Classification Search ..... 2/2.11, 2/2.14, 2.17, 4, 5, 84, 85, 86, 88, 93, 108, 2/195.2, 202, 410, 417, 418, 424, 456
See application file for complete search history.

(56) References Cited

U.S. PATENT DOCUMENTS 2,344,811 A * 3/1944 Gill ..... 2/4
4,422,184 A * 12/1983 Myers ..... 2/4
4,685,152 A * 8/1987 Heare ..... 2/4
5,357,635 A * 10/1994 Lemoine ..... 2/84
5,794,263 A * 8/1998 Carman ..... 2/84
5,915,535 A * 6/1999 Henrekin-Jordan ..... 2/195.2
2005/0160514 A1* 7/2005 Flaniken ..... 2/84
2008/0271221 A1* 11/2008 Zmigrosky ..... 2/79

* cited by examiner

*Primary Examiner* — Khoa Huynh
*Assistant Examiner* — Alissa Tompkins
(74) *Attorney, Agent, or Firm* — Albert Bordas, P.A.

(57) ABSTRACT

An article of clothing, comprising a coat assembly having a front side, a backside, and first and second sleeves. The front side and the backside define a shoulder area where they meet above the first and second sleeves. A hood assembly has a crown. Extending from the crown is a flap that terminates at an end. Also extending from the crown at a predetermined angle is a visor. The visor extends from the crown a first predetermined distance. The hood assembly comprises a first zipper tape. The first zipper tape comprises first zipper teeth. A shield assembly comprises a shield. The shield has a second zipper tape. The second zipper tape comprises second zipper teeth. The second zipper teeth have means to engage the first zipper teeth.

16 Claims, 3 Drawing Sheets

ARTICLE OF CLOTHING

BACKGROUND OF THE INVENTION

1. Field of the Invention

The present invention relates to clothing, and more particularly, to an article of clothing covering at least an upper torso.

2. Description of the Related Art

Often times in severe weather conditions, people have trouble staying dry with traditional raincoats, even with the use of an umbrella. This problem is heightened when a person rides on a motor vehicle, such as a motorcycle, while exposed to the weather conditions. Many articles of clothing have been designed in the past. None of them however, include the novel features of the present invention.

SUMMARY OF THE INVENTION

The instant invention is an article of clothing, comprising a coat assembly having a front side, a backside, and first and second sleeves. The front side and the backside define a shoulder area where they meet above the first and second sleeves. A hood assembly has a crown. Extending from the crown is a flap that terminates at an end. Also extending from the crown at a predetermined angle is a visor. The visor extends from the crown a first predetermined distance. The hood assembly comprises a first zipper tape. The first zipper tape comprises first zipper teeth. A shield assembly comprises a shield. The shield has a second zipper tape. The second zipper tape comprises second zipper teeth. The second zipper teeth have means to engage the first zipper teeth.

The shield assembly extends substantially perpendicularly and downwardly from the visor from a position less than the first predetermined distance. The shield assembly extends substantially perpendicularly and downwardly from the visor a second predetermined distance. The hood assembly further comprises a strap with adjusting means to adjust sizing of the crown, and the adjusting means is a buckle. The coat assembly further comprises a zipper assembly, and the shield is transparent. The coat assembly, the hood assembly, and the shield assembly are made of an impermeable material, and the shield assembly is removable from the hood assembly.

It is therefore one of the main objects of the present invention to provide an article of clothing that keeps a user dry.

It is another object of this invention to provide an article of clothing that protects the user from weather conditions.

It is another object of this invention to provide an article of clothing that protects the user's face without restricting vision.

It is another object of this invention to provide an article of clothing that comprises a coat assembly, a hood assembly, and a shield assembly.

It is yet another object of this invention to provide such an article of clothing that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 2:
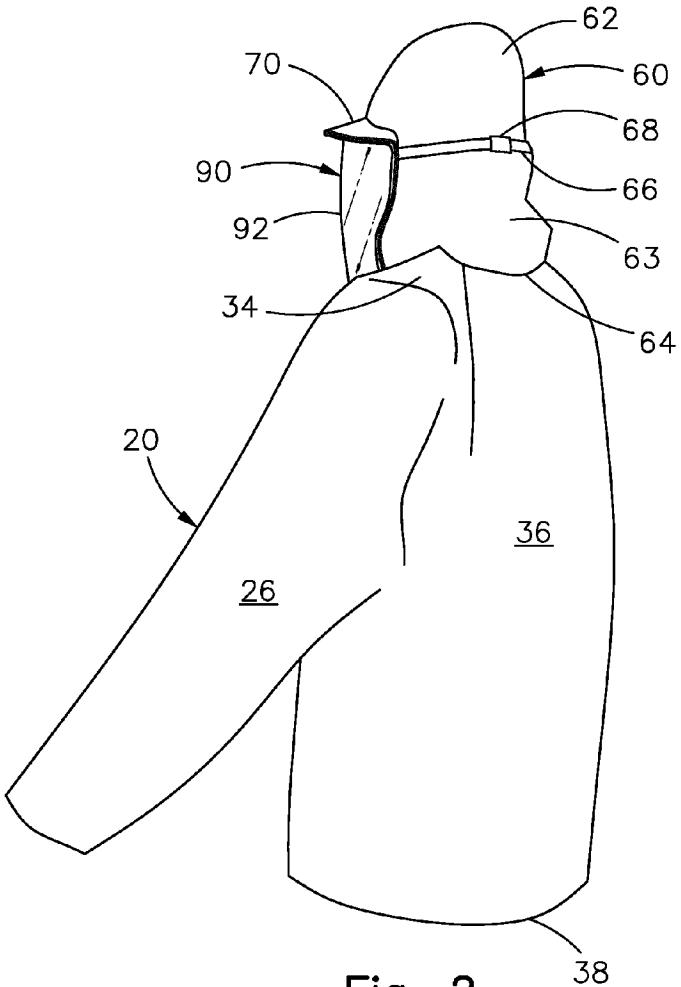
FIG. 2 illustrates a rear isometric view of the present invention.

Referring now to the drawings, the present invention is generally referred to with numeral 10. It can be observed that it basically includes coat assembly 20, hood assembly 60, and shield assembly 90.

Figure 1:
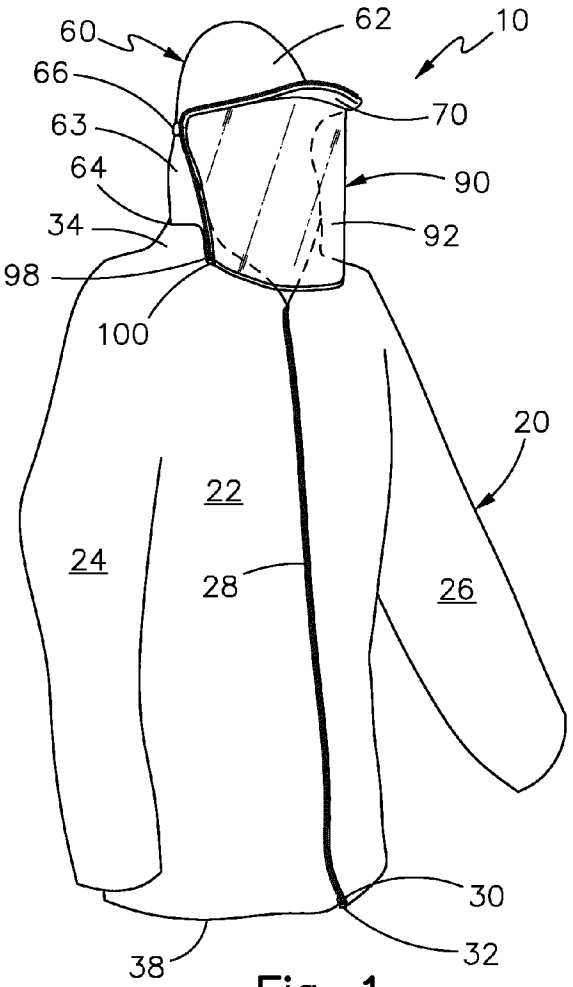
FIG. 1 illustrates a front isometric view of the present invention.

As seen in FIGS. 1 and 2, coat assembly 20 is designed to cover an upper torso of a user. Coat assembly 20 comprises front side 22, sleeves 24 and 26, and back side 36. Front side 22 and backside 36 terminate at end 38. Meeting above sleeves 24 and 26, front side 22 and backside 36 define shoulder area 34. Coat assembly 20 also comprises zipper assembly 28 having slide 30 and pull tab 32.

Figure 4:
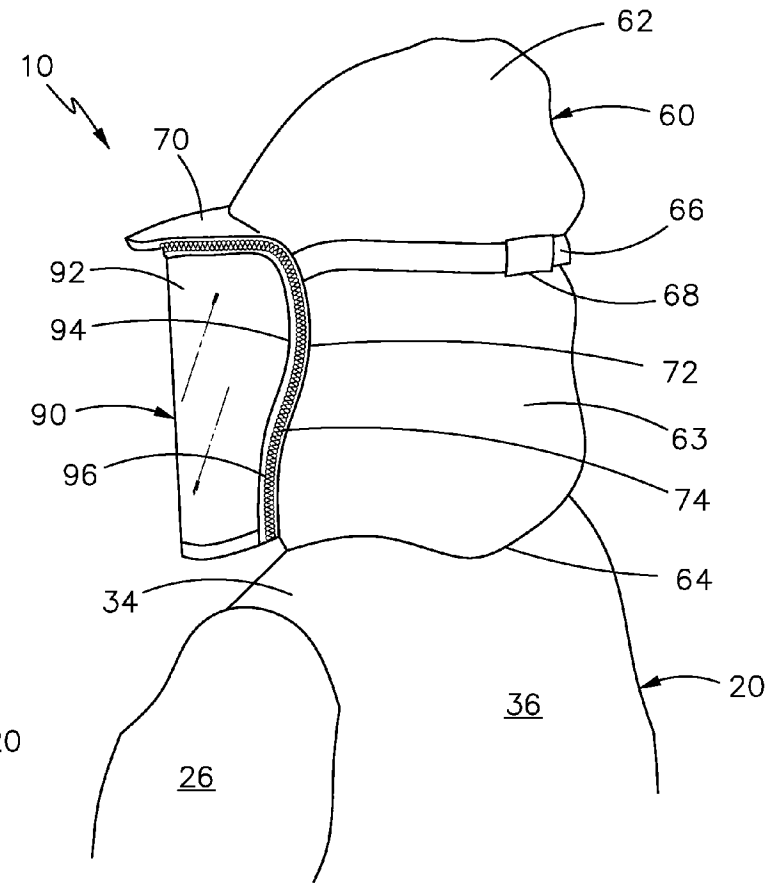
FIG. 4 illustrates a left side isometric view of the hood and shield assemblies.
Figure 3:
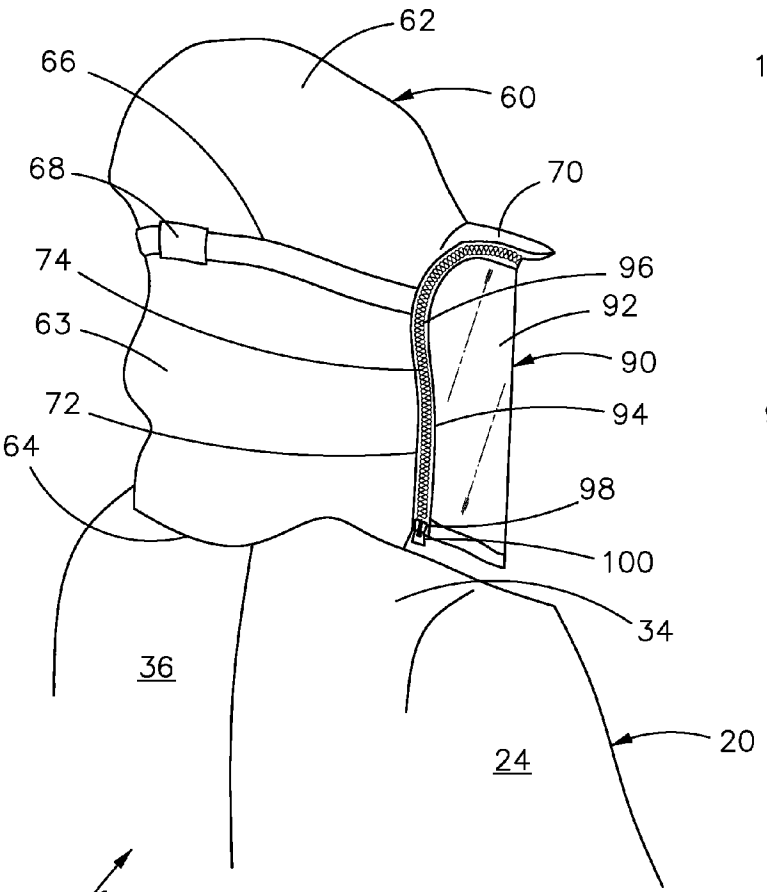
FIG. 3 illustrates a right side isometric view of the hood and shield assemblies.

As seen in FIGS. 3 and 4, hood assembly 60 comprises crown 62. Extending from crown 62 is flap 63 that terminates at end 64. End 64 is attached to coat assembly 20. Also extending from crown 62, at a predetermined angle is visor 70. Visor 70 extends from crown 62 a first predetermined distance. Hood assembly 60 comprises zipper tape 72 having zipper teeth 74. Zipper tape 72 is mounted onto lateral edges of flap 63, and at a predetermined distance inwardly from a distal edge of visor 70. Hood assembly 60 further comprises strap 66 having buckle 68 to adjust the size of crown 62 as needed as adjusting means.

Figure 6:
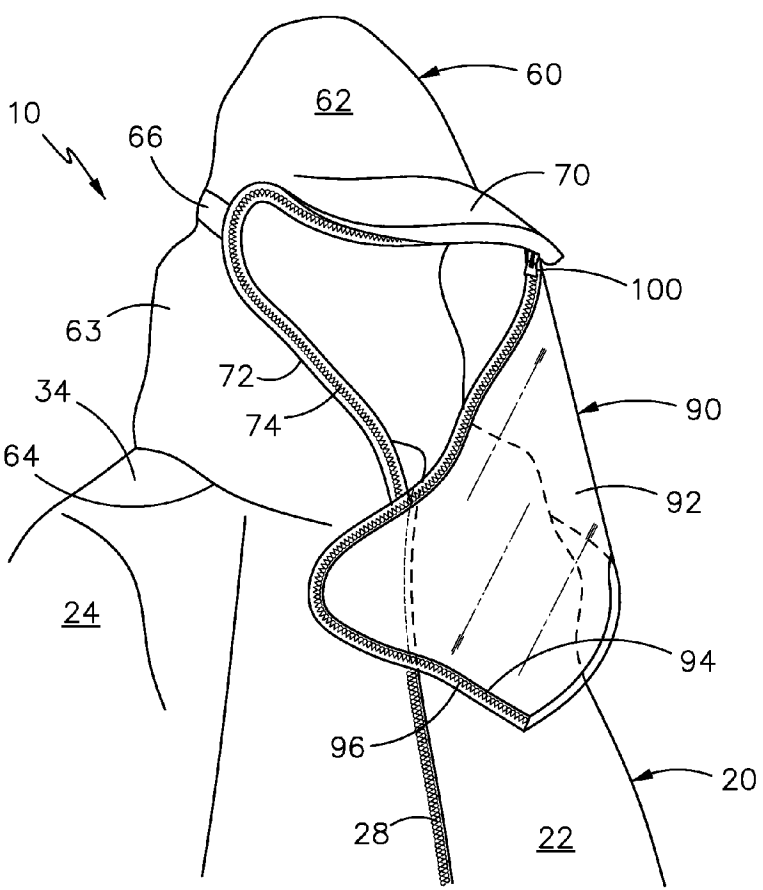
FIG. 6 illustrates a front isometric view of the present invention with the shield assembly partially removed from the hood assembly.
Figure 5:
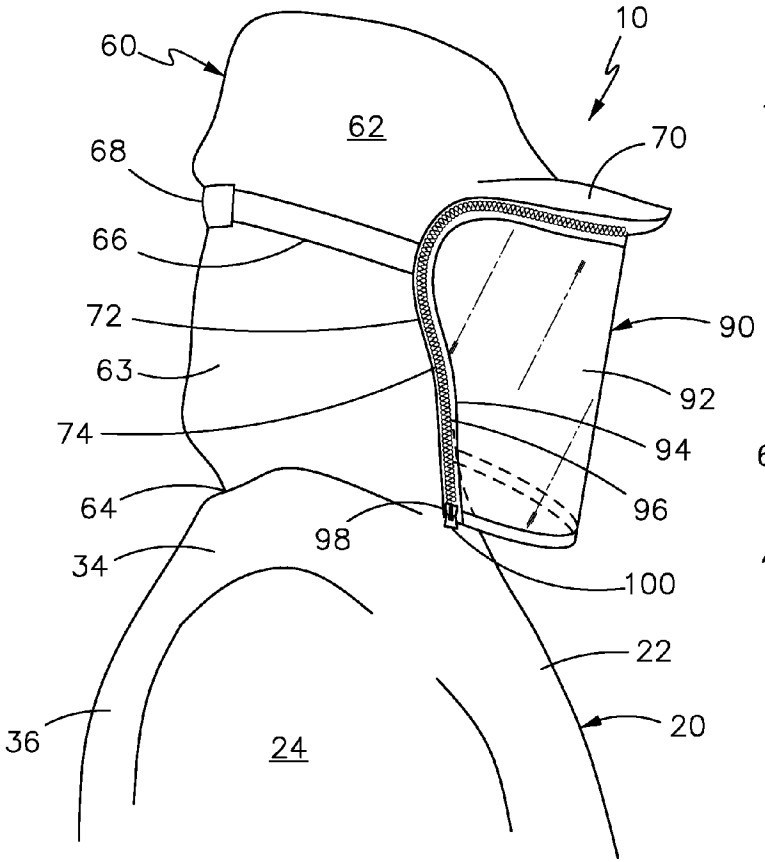
FIG. 5 illustrates a right side elevational view of the hood and shield assemblies.

As seen in FIGS. 5 and 6, shield assembly 90 is made out of a transparent and semi rigid material. Shield assembly 90 comprises shield 92. Shield 92 has zipper tape 94 having zipper teeth 96. Zipper teeth 96 have slide 98 and pull tab 100 as means to engage zipper teeth 74 of hood assembly 60. When engaged onto hood assembly 60, shield assembly 90 extends substantially perpendicularly and downwardly from visor 70 a predetermined distance. Shield assembly 90 also extends substantially perpendicularly and downwardly at a predetermined distance from the distal edge of visor 70. Shield 92 has cooperative dimensions and convex shaping to provide an outwardly curved disposition when engaged onto hood assembly 60. This shape creates a distance between a user's face and visor 70 to allow easy breathing and comfort when worn.

As best seen in FIG. 6, shield assembly 90 is removable from hood assembly 60, whereby the user utilizes pull-tab 100 to engage or disengage zipper teeth 96 from zipper teeth 74.

In use, instant invention 10 can be worn during light or severe weather conditions including wind and several kinds of precipitation such as rain, freezing rain, snow, hail, and sleet. Instant invention 10 can be used without the aid of an umbrella, and is especially useful when a person rides on a motor vehicle, such as a motorcycle, while exposed to the weather conditions. In the preferred embodiment, instant invention 10 is made of an impermeable material. Individuals exposed to the weather conditions while performing services or doing work can also wear instant invention 10. Such individuals can be construction workers, ramp personnel at an airport, and road workers as an example.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. An article of clothing, comprising:

A) a coat assembly having a front side, a back side, and first and second sleeves, said front side and said back side defining a shoulder area where they meet above said first and second sleeves;

B) a hood assembly having a crown, extending from said crown is a flap terminating at an end, also extending from said crown at a predetermined angle is a visor, said visor extending from said crown a first predetermined distance, said hood assembly comprising a first zipper tape, said first zipper tape comprising first zipper teeth, said hood assembly further comprises a strap located on an exterior surface of said hood assembly with adjusting means to adjust sizing of said crown, said strap stretches around a back of a wearer's head from a first side of said first zipper tape to a second side of said first zipper tape, said hood is permanently attached to said coat assembly; wherein said strap comprises a first end and a second end; said first end connects to said first side of said first zipper tape and said second end connects to said second side of said first zipper tape; and C) a shield assembly comprising a shield, said shield having a second zipper tape, said second zipper tape comprising second zipper teeth, said second zipper teeth having means to engage said first zipper teeth.

2. The article of clothing set forth in claim 1, further characterized in that said shield assembly extends substantially perpendicularly and downwardly from said visor.

3. The article of clothing set forth in claim 1, further characterized in that said shield assembly extends substantially perpendicularly and downwardly from said visor from a position less than said first predetermined distance.

4. The article of clothing set forth in claim 1, further characterized in that said shield assembly extends substantially perpendicularly and downwardly from said visor a second predetermined distance.

5. The article of clothing set forth in claim 1, further characterized in that said adjusting means is a buckle.

6. The article of clothing set forth in claim 1, further characterized in that said coat assembly further comprises a zipper assembly.

7. The article of clothing set forth in claim 1, further characterized in that said shield is transparent.

8. The article of clothing set forth in claim 1, further characterized in that said coat assembly, said hood assembly, and said shield assembly are made of an impermeable material.

9. The article of clothing set forth in claim 1, further characterized in that said shield assembly is removable from said hood assembly.

10. An article of clothing, comprising:

A) a coat assembly having a front side, a back side, and first and second sleeves, said front side and said back side defining a shoulder area where they meet above said first and second sleeves;

B) a hood assembly having a crown, extending from said crown is a flap terminating at an end, also extending from said crown at a predetermined angle is a visor, said visor extending from said crown a first predetermined distance, said hood assembly comprising a first zipper tape, said first zipper tape comprising first zipper teeth, said hood assembly further comprises a strap located on an exterior surface of said hood assembly with adjusting means to adjust sizing of said crown, said strap stretches around a back of a wearer's head from a first side of said first zipper tape to a second side of said first zipper tape, said hood is permanently attached to said coat assembly; wherein said strap comprises a first end and a second end; said first end connects to said first side of said first zipper tape and said second end connects to said second side of said first zipper tape; and C) a shield assembly comprising a shield, said shield having a second zipper tape, said second zipper tape comprising second zipper teeth, said second zipper teeth having means to engage said first zipper teeth, said shield assembly extends substantially perpendicularly and downwardly from said visor from a position less than said first predetermined distance.

11. The article of clothing set forth in claim 10, further characterized in that said shield assembly extends from said visor a second predetermined distance.

12. The article of clothing set forth in claim 11, further characterized in that said adjusting means is a buckle.

13. The article of clothing set forth in claim 12, further characterized in that said coat assembly further comprises a zipper assembly.

14. The article of clothing set forth in claim 13, further characterized in that said shield is transparent.

15. The article of clothing set forth in claim 14, further characterized in that said coat assembly, said hood assembly, and said shield assembly are made of an impermeable material.

16. The article of clothing set forth in claim 15, further characterized in that said shield assembly is removable from said hood assembly.

* * * * *